US010851809B2

(12) United States Patent
Kondo et al.

(10) Patent No.: US 10,851,809 B2
(45) Date of Patent: Dec. 1, 2020

(54) HYDRAULIC SYSTEM

(71) Applicant: KAWASAKI JUKOGYO KABUSHIKI KAISHA, Kobe (JP)

(72) Inventors: Akihiro Kondo, Kobe (JP); Hideyasu Muraoka, Akashi (JP)

(73) Assignee: KAWASAKI JUKOGYO KABUSHIKI KAISHA, Kobe (JP)

( * ) Notice: Subject to any disclaimer, the term of this patent is extended or adjusted under 35 U.S.C. 154(b) by 0 days.

(21) Appl. No.: 16/623,273

(22) PCT Filed: Jun. 14, 2018

(86) PCT No.: PCT/JP2018/022723
§ 371 (c)(1),
(2) Date: Dec. 16, 2019

(87) PCT Pub. No.: WO2018/230642
PCT Pub. Date: Dec. 20, 2018

(65) Prior Publication Data

US 2020/0182265 A1 Jun. 11, 2020

(30) Foreign Application Priority Data

Jun. 16, 2017 (JP) ..... 2017-118568

(51) Int. Cl.
*F15B 11/042* (2006.01)
*F15B 11/16* (2006.01)

(52) U.S. Cl.
CPC ..... *F15B 11/0423* (2013.01); *F15B 11/165* (2013.01); *F15B 2211/45* (2013.01); *F15B 2211/6346* (2013.01)

(58) Field of Classification Search
CPC ... F15B 11/0423; F15B 11/165; F15B 11/167; F15B 2211/45; F15B 2211/6346
See application file for complete search history.

(56) References Cited

U.S. PATENT DOCUMENTS 5,394,697 A * 3/1995 Hirata ..... E02F 9/2235 60/426
5,680,760 A * 10/1997 Lunzman ..... E02F 9/2228 60/426

(Continued)

FOREIGN PATENT DOCUMENTS

CN 106795897 A 5/2017
JP H07-063203 A 3/1995

*Primary Examiner* — Michael Leslie
(74) *Attorney, Agent, or Firm* — Oliff PLC

(57) ABSTRACT

A hydraulic system includes: an operation device that outputs an operation signal corresponding to an operating amount of an operating unit; a pump that supplies hydraulic oil to a hydraulic actuator via a control valve; a bleed valve that defines a bleed flow rate, at which the hydraulic oil is released to a tank; and a controller that controls the bleed valve, so an opening area of the valve decreases in accordance with increase in the operation signal. The controller: when a rapid acceleration operation is not performed on the device, changes the opening area of the valve between a maximum value and zero along a normal opening line; and when the rapid acceleration operation is performed, changes the opening area of the valve between the maximum value and minimum value greater than zero along a special opening line from when the operation is started until a predetermined time elapses.

6 Claims, 4 Drawing Sheets

(56) References Cited

U.S. PATENT DOCUMENTS

| | | | | |
|---|---|---|---|---|
| 5,873,245 | A * | 2/1999 | Kato | E02F 9/2225 60/445 |
| 7,155,909 | B2 * | 1/2007 | Toji | E02F 9/2228 60/468 |
| 9,303,387 | B2 * | 4/2016 | Pfaff | F15B 11/0423 |
| 10,273,659 | B2 * | 4/2019 | Kondo | E02F 9/2282 |
| 10,655,650 | B2 * | 5/2020 | Werner | F15B 13/08 |
| 2018/0347958 | A1 | 12/2018 | Kondo et al. | |
| 2020/0158143 | A1 * | 5/2020 | Kondo | F15B 11/05 |

* cited by examiner

HYDRAULIC SYSTEM

TECHNICAL FIELD

The present invention relates to a hydraulic system including a bleed valve.

BACKGROUND ART

Conventionally, a hydraulic system in which hydraulic oil is supplied from a pump to a hydraulic actuator via a control valve is used in, for example, construction machines and industrial machines. Such a hydraulic system may include a bleed valve (which is also referred to as an unloading valve) that releases the hydraulic oil discharged from the pump to a tank.

For example, Patent Literature 1 discloses a hydraulic system including: a bleed valve that is moved by an electrical signal; and a controller that controls the bleed valve. The controller controls the bleed valve, such that the opening area of the bleed valve decreases in accordance with increase in the operating amount of an operation device that is intended for moving a hydraulic actuator.

CITATION LIST

Patent Literature

PTL 1: Japanese Laid-Open Patent Application Publication No. H07-63203

SUMMARY OF INVENTION

Technical Problem

When a rapid acceleration operation (an operation of rapidly increasing the speed of the hydraulic actuator) is performed on the operation device, for example, when the operation device is operated from a neutral state to a fully operated state instantaneously, the opening area of the bleed valve changes instantaneously, and the amount of hydraulic oil supplied to the hydraulic actuator increases rapidly. At the time, hunting in the behavior of the hydraulic actuator is likely to occur due to the inertia of the hydraulic actuator and the compressibility of the hydraulic oil.

In order to suppress the hunting and stabilize the behavior of the hydraulic actuator, it is conceivable to set the minimum opening area of the bleed valve to be greater than zero. However, in the case of adopting such a setting, when a slow acceleration operation (an operation of slowly increasing the speed of the hydraulic actuator) is performed on the operation device, not only does the discharge pressure of the pump not increase to a target pressure, but also the hydraulic oil from the pump is always released to the tank through the bleed valve. As a result, energy used for driving the pump is consumed wastefully.

In view of the above, an object of the present invention is to provide a hydraulic system that makes it possible to stabilize the behavior of the hydraulic actuator at the time of performing the rapid acceleration operation while suppressing wasteful energy consumption.

Solution to Problem

In order to solve the above-described problems, a hydraulic system according to the present invention includes: an operation device that outputs an operation signal corresponding to an operating amount of an operating unit; a pump that supplies hydraulic oil to a hydraulic actuator via a control valve; a bleed valve that defines a bleed flow rate, at which the hydraulic oil discharged from the pump is released to a tank; and a controller that controls the bleed valve, such that an opening area of the bleed valve decreases in accordance with increase in the operation signal outputted from the operation device. The controller determines whether or not a rapid acceleration operation is performed on the operation device. The controller: in a case where the rapid acceleration operation is not performed, changes the opening area of the bleed valve between a maximum value and zero along a normal opening line; and in a case where the rapid acceleration operation is performed, changes the opening area of the bleed valve between the maximum value and a minimum value greater than zero along a special opening line from when the rapid acceleration operation is started until when a predetermined time elapses.

According to the above configuration, at the time of performing the rapid acceleration operation, the opening area of the bleed valve is kept greater than zero from when the rapid acceleration operation is started until when the predetermined time elapses. This makes it possible to stabilize the behavior of the hydraulic actuator. On the other hand, in a case where the rapid acceleration operation is not performed, the opening area of the bleed valve changes along the normal opening line, and when the operating amount becomes great, the opening area of the bleed valve becomes zero. This makes it possible to suppress wasteful energy consumption.

In the case where the rapid acceleration operation is performed, when the predetermined time has elapsed from the start of the rapid acceleration operation, the controller may shift the opening area of the bleed valve from a point on the special opening line to a point on the normal opening line. Even after the predetermined time has elapsed from the start of the rapid acceleration operation, it is possible to keep the opening area of the bleed valve to a point on the special opening line. However, if the opening area of the bleed valve is shifted to a point on the normal opening line when the predetermined time has elapsed from the start of the rapid acceleration operation, wasteful energy consumption can be suppressed also after the predetermined time has elapsed at the time of performing the rapid acceleration operation.

For example, the pump may be a variable displacement pump. The above hydraulic system may further include a regulator that adjusts a tilting angle of the pump. The controller may control the regulator, such that a discharge flow rate of the pump increases in accordance with increase in the operation signal outputted from the operation device.

Alternatively, the pump may be a variable displacement pump. The above hydraulic system may further include: a control valve interposed between the pump and the hydraulic actuator, the control valve adjusting an amount of the hydraulic oil supplied to the hydraulic actuator; and a regulator that adjusts a tilting angle of the pump, such that a pressure difference between an upstream-side pressure and a downstream-side pressure of a meter-in restrictor of the control valve is constant, the regulator increasing a discharge flow rate of the pump in accordance with increase in the operation signal outputted from the operation device.

Advantageous Effects of Invention

The present invention makes it possible to stabilize the behavior of the hydraulic actuator at the time of performing the rapid acceleration operation while suppressing wasteful energy consumption.

BRIEF DESCRIPTION OF DRAWINGS

FIG. 3A shows temporal changes in the operating amount; and FIG. 3B shows temporal changes in the opening area of the bleed valve.

FIG. 4A shows temporal changes in the operating amount; and FIG. 4B shows temporal changes in the opening area of the bleed valve.

DESCRIPTION OF EMBODIMENTS

Figure 1:
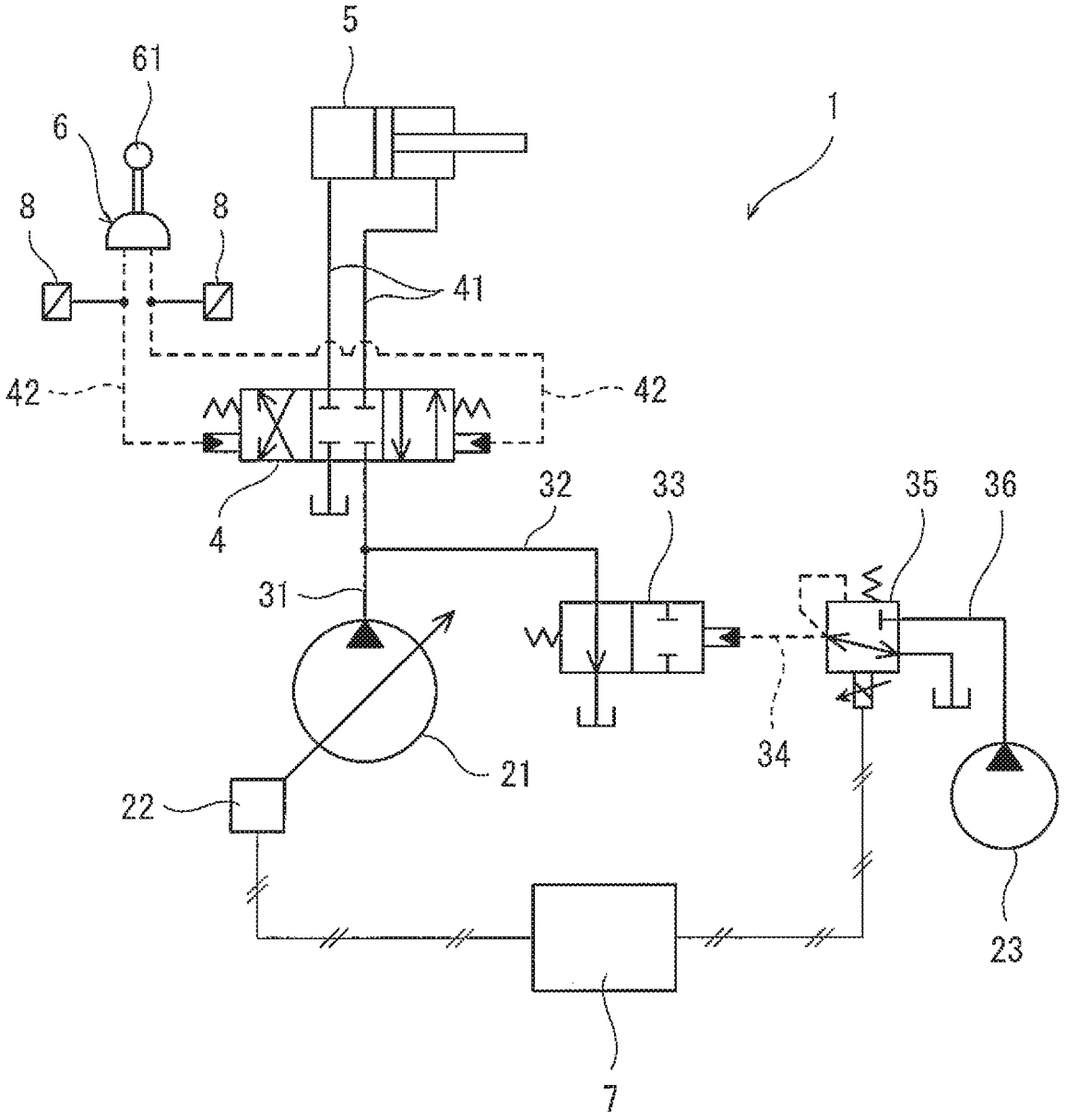
FIG. 1 shows a schematic configuration of a hydraulic system according to one embodiment of the present invention.

FIG. 1 shows a hydraulic system 1 according to one embodiment of the present invention. For example, the hydraulic system 1 is installed in a construction machine, such as a hydraulic excavator or a hydraulic crane, or in a civil engineering machine, an agricultural machine, or an industrial machine.

Specifically, the hydraulic system 1 includes: a hydraulic actuator 5; and a main pump 21, which supplies hydraulic oil to the hydraulic actuator 5 via a control valve 4. In the illustrated example, the number of sets of the hydraulic actuator 5 and the control valve 4 is one. However, as an alternative, the number of sets of the hydraulic actuator 5 and the control valve 4 may be plural.

The main pump 21 is a variable displacement pump whose tilting angle is changeable. The main pump 21 may be a swash plate pump, or may be a bent axis pump. The tilting angle of the main pump 21 is adjusted by a regulator 22.

The main pump 21 is connected to the control valve 4 by a supply line 31. The discharge pressure of the main pump 21 is kept to a relief pressure or lower by an unshown relief valve.

In the present embodiment, the hydraulic actuator 5 is a double-acting cylinder, and the control valve 4 is connected to the hydraulic actuator 5 by a pair of supply/discharge lines 41. However, as an alternative, the hydraulic actuator 5 may be a single-acting cylinder, and the control valve 4 may be connected to the hydraulic actuator 5 by a single supply/discharge line 41. Further alternatively, the hydraulic actuator 5 may be a hydraulic motor.

The control valve 4 is interposed between the main pump 21 and the hydraulic actuator 5, and adjusts the amount of hydraulic oil supplied to the hydraulic actuator 5. As a result of an operation device 6 being operated, the position of the control valve 4 is switched from a neutral position to a first position (a position for moving the hydraulic actuator 5 in one direction) or to a second position (a position for moving the hydraulic actuator 5 in a direction opposite to the one direction). In the present embodiment, the control valve 4 is a hydraulic pilot control valve that includes a pair of pilot ports. However, as an alternative, the control valve 4 may be a solenoid pilot control valve. When the control valve 4 is in the first position or the second position, an opening of the control valve 4, the opening allowing the supply line 31 and one of the supply/discharge lines 41 to communicate with each other, functions as a meter-in restrictor.

The operation device 6 includes an operating unit 61, and outputs an operation signal corresponding to an operating amount of the operating unit 61. That is, the operation signal outputted from the operation device 6 increases in accordance with increase in the operating amount. The operating unit 61 is, for example, an operating lever. Alternatively, the operating unit 61 may be a foot pedal or the like.

Figure 2A:
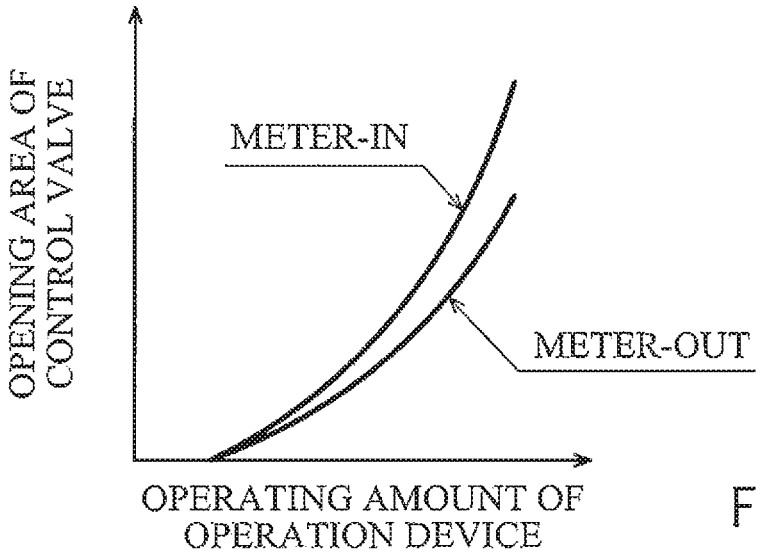
FIG. 2A is a graph showing a relationship between the operating amount of an operating unit of an operation device and the opening area of a control valve.

In the present embodiment, the operation device 6 is a pilot operation valve that outputs a pilot pressure as the operation signal. Accordingly, the operation device 6 is connected to the pilot ports of the control valve 4 by a pair of pilot lines 42. As shown in FIG. 2A, the control valve 4 increases the opening area of a meter-in opening intended for supplying the hydraulic oil to the hydraulic actuator 5 and the opening area of a meter-out opening intended for discharging the hydraulic oil from the hydraulic actuator 5 in accordance with increase in the pilot pressure (operation signal) outputted from the operation device 6.

The operation device 6 may be an electrical joystick that outputs an electrical signal as the operation signal. In this case, each pilot port of the control valve 4 is connected to a secondary pressure port of a solenoid proportional valve.

In the present embodiment, the aforementioned regulator 22 is moved by an electrical signal. For example, in a case where the main pump 21 is a swash plate pump, the regulator 22 may electrically change the hydraulic pressure applied to a servo piston coupled to the swash plate of the main pump 21, or may be an electric actuator coupled to the swash plate of the main pump 21.

The regulator 22 is controlled by a controller 7. For example, the controller 7 includes a CPU and memories such as a ROM and RAM, and the CPU executes a program stored in the ROM.

The controller 7 is electrically connected to pressure sensors 8, which are provided on the aforementioned pair of pilot lines 42, respectively. It should be noted that FIG. 1 shows only part of signal lines for simplifying the drawing.

Each pressure sensor 8 detects the pilot pressure outputted from the operation device 6. The controller 7 controls the regulator 22, such that the discharge flow rate of the main pump 21 increases in accordance with increase in the pilot pressure (operation signal) detected by the pressure sensor 8.

Figure 5:
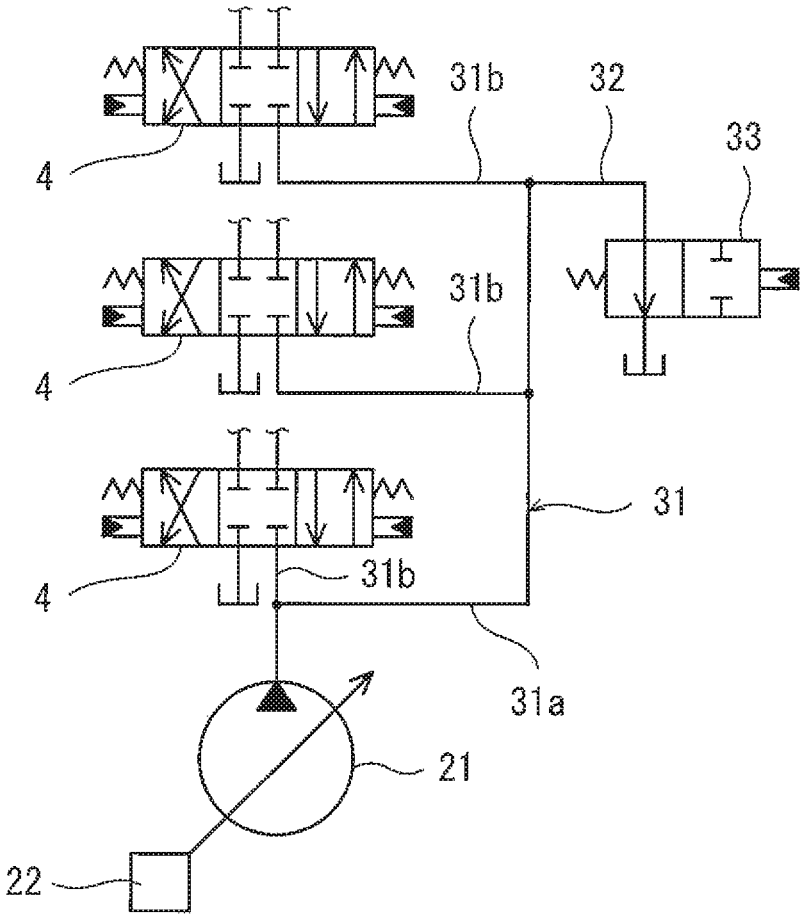
FIG. 5 shows a variation in which a plurality of control valves are present.

A bleed line 32 is branched off from the aforementioned supply line 31. The bleed line 32 is provided with a bleed valve 33. The bleed valve 33 defines a bleed flow rate, at which the hydraulic oil discharged from the main pump 21 is released to a tank. In the illustrated example, the bleed valve 33 is disposed upstream of the control valve 4. FIG. 5 shows a case in which: a plurality of the control valves 4 are present; and the supply line 31 includes a main passage 31*a* and parallel passages 31*b* connecting between the main passage 31*a* and pump ports of the respective control valves 4. In this case, the bleed line 32 may be branched off from the main passage 31*a* at a position downstream of all the parallel passages 31*b*.

In the present embodiment, the bleed valve 33 includes a pilot port, and the opening area of the bleed valve 33 decreases from a fully opened state to a fully closed state in accordance with increase in pilot pressure. It should be noted that the bleed valve 33 need not be moved by a pilot pressure, but may be moved by an electrical signal.

The bleed valve 33 is controlled by the controller 7 via a solenoid proportional valve 35. Specifically, the pilot port of the bleed valve 33 is connected to a secondary pressure port of the solenoid proportional valve 35 by a secondary pressure line 34. A primary pressure port of the solenoid proportional valve 35 is connected to an auxiliary pump 23 by a primary pressure line 36. The discharge pressure of the auxiliary pump 23 is kept to a setting pressure by an unshown relief valve.

In the present embodiment, the solenoid proportional valve 35 is a direct-proportional valve whose output secondary pressure and a command current fed to the solenoid proportional valve 35 indicate a positive correlation. However, as an alternative, the solenoid proportional valve 35 may be an inverse proportional valve whose output secondary pressure and the command current fed to the solenoid proportional valve 35 indicate a negative correlation.

The controller 7 controls the bleed valve 33, such that the opening area of the bleed valve 33 decreases in accordance with increase in the pilot pressure (operation signal) outputted from the operation device 6. Further, in the present embodiment, the controller 7 determines whether or not a rapid acceleration operation (an operation of rapidly increasing the speed of the hydraulic actuator 5) is performed on the operation device 6. Based on a result of the determination, the controller 7 varies the control of the bleed valve 33.

Specifically, the controller 7 determines whether or not the time rate of change in the pilot pressure detected by each pressure sensor 8 is greater than a threshold. A case where the time rate of change in the pilot pressure is greater than the threshold is a case where the rapid acceleration operation is performed. A case where the time rate of change in the pilot pressure is less than the threshold is a case where the rapid acceleration operation is not performed. Examples of the case where the rapid acceleration operation is not performed include: a case where a slow acceleration operation is performed; a case where the operating amount is kept; and a case where a deceleration operation (an operation of decreasing the speed of the hydraulic actuator 5) is performed.

Figure 2B:
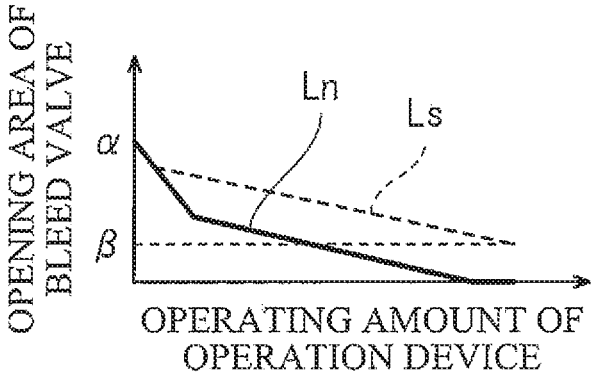
FIG. 2B is a graph showing a relationship between the operating amount of the operating unit of the operation device and the opening area of a bleed valve.

In a case where the rapid acceleration operation is not performed, as shown in FIG. 2B, the controller 7 changes the opening area of the bleed valve 33 between a maximum value $\alpha$ and zero along a normal opening line Ln. In the present embodiment, the normal opening line Ln is constituted by a first linear portion whose inclination has a larger absolute value and a second linear portion whose inclination has a smaller absolute value, such that over a relatively narrow initial range, the opening area of the bleed valve 33 greatly decreases from the maximum value $\alpha$, and then over a relatively wide range, the opening area of the bleed valve 33 slowly decreases to zero.

Figure 4A:
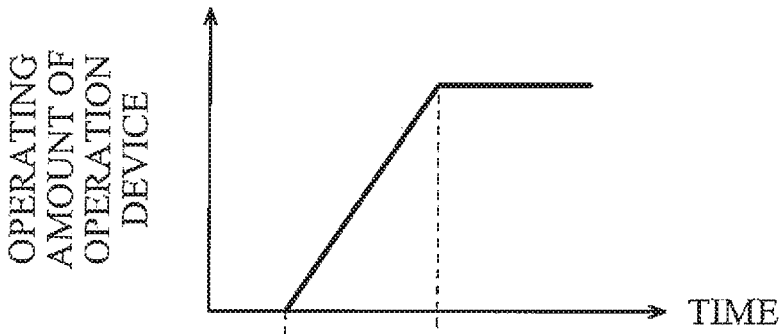
FIGS. 4A and 4B are graphs when a slow acceleration operation is performed on the operation device.
Figure 4B:
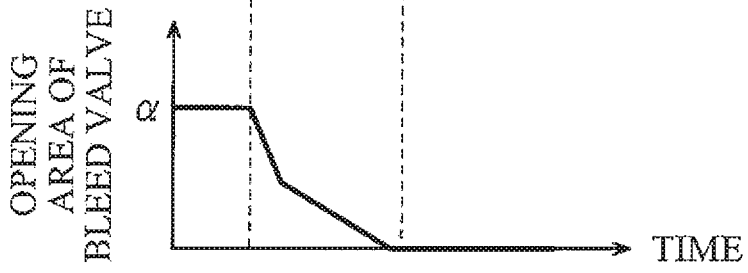

For example, in a case where the slow acceleration operation is performed in a manner to operate the operation device from a neutral state to a fully operated state as shown in FIG. 4A, the opening area of the bleed valve 33 gradually decreases from the maximum value to zero as shown in FIG. 4B.

On the other hand, in a case where the rapid acceleration operation is performed, the controller 7 changes the opening area of the bleed valve 33 between the maximum value $\alpha$ and a minimum value $\beta$ greater than zero along a special opening line Ls from when the rapid acceleration operation is started until when a predetermined time T elapses. In the present embodiment, the special opening line Ls is constituted by a first linear portion whose inclination has a larger absolute value and a second linear portion whose inclination has a smaller absolute value, such that over a relatively narrow initial range, the opening area of the bleed valve 33 greatly decreases from the maximum value $\alpha$, and then over a relatively wide range, the opening area of the bleed valve 33 slowly decreases to the minimum value $\beta$.

In the present embodiment, the first linear portion of the special opening line Ls is shorter than the first linear portion of the normal opening line Ln, and overlaps the first linear portion of the normal opening line Ln. The second linear portion of the special opening line Ls is parallel to the second linear portion of the normal opening line Ln.

Further, in a case where the rapid acceleration operation is performed, when the predetermined time T has elapsed from the start of the rapid acceleration operation, the controller 7 shifts the opening area of the bleed valve 33 from a point on the special opening line Ls to a point on the normal opening line Ln, such that the point on the normal opening line Ln corresponds to the same pilot pressure (operation signal) as a pilot pressure (operation signal) that the point on the special opening line Ls corresponds to.

Figure 3A:
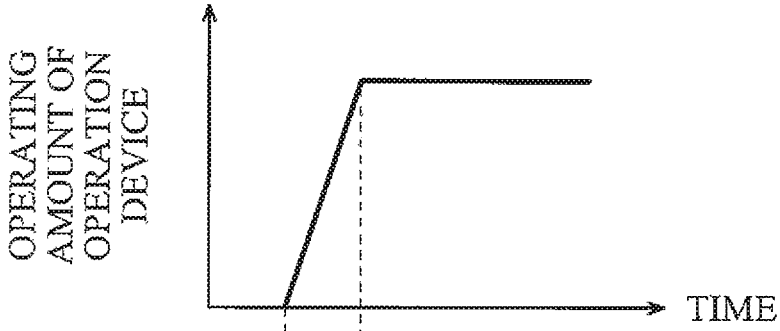
FIGS. 3A and 3B are graphs when a rapid acceleration operation is performed on the operation device.
Figure 3B:
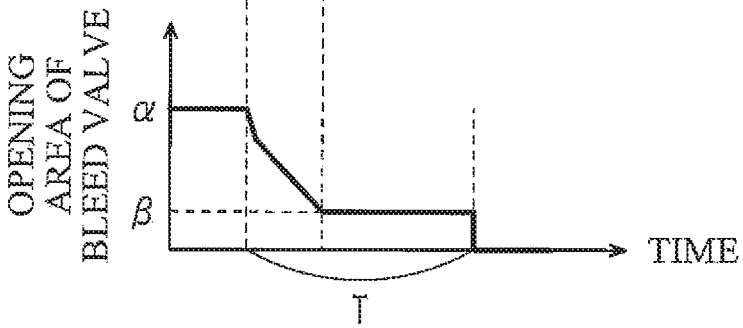

For example, in a case where the rapid acceleration operation is performed in a manner to operate the operation device from the neutral state to the fully operated state as shown in FIG. 3A, the opening area of the bleed valve 33 gradually decreases from the maximum value $\alpha$ to the minimum value $\beta$ as shown in FIG. 3B. Thereafter, the opening area of the bleed valve 33 is kept to the minimum value $\beta$ until the predetermined time T elapses from the start of the rapid acceleration operation, and after the predetermined time has elapsed, becomes zero.

As described above, in the hydraulic system 1 of the present embodiment, at the time of performing the rapid acceleration operation, the opening area of the bleed valve 33 is kept greater than zero from when the rapid acceleration operation is started until when the predetermined time T elapses. This makes it possible to stabilize the behavior of the hydraulic actuator 5. On the other hand, in a case where the rapid acceleration operation is not performed, the opening area of the bleed valve 33 changes along the normal opening line Ln, and when the operating amount becomes great, the opening area of the bleed valve 33 becomes zero. This makes it possible to suppress wasteful energy consumption.

Even after the predetermined time T has elapsed from the start of the rapid acceleration operation, it is possible to keep the opening area of the bleed valve 33 to a point on the special opening line Ls. However, if the opening area of the bleed valve 33 is shifted to a point on the normal opening line Ln when the predetermined time T has elapsed from the start of the rapid acceleration operation as in the present embodiment, wasteful energy consumption can be suppressed also after the predetermined time T has elapsed at the time of performing the rapid acceleration operation.

(Variations)

The present invention is not limited to the above-described embodiment. Various modifications can be made without departing from the spirit of the present invention.

For example, the regulator 22 need not be moved by an electrical signal, but may be moved by a pilot pressure. In this case, the discharge flow rate of the main pump 21 may be controlled by, for example, load-sensing control.

In a case where the discharge flow rate of the main pump 21 is controlled by load-sensing control, the discharge pressure of the main pump 21 and the supply side pressure (load pressure) of the hydraulic actuator 5 are led to the regulator 22. The regulator 22 adjusts the tilting angle of the main pump 21 such that the pressure difference between the upstream-side pressure and the downstream-side pressure of the meter-in restrictor of the control valve 4 is constant, and increases the discharge flow rate of the main pump 21 in accordance with increase in the operation signal outputted from the operation device 6.

REFERENCE SIGNS LIST

1 hydraulic system
21 main pump
22 regulator
33 bleed valve
4 control valve
5 hydraulic actuator
6 operation device
61 operating unit
7 controller

The invention claimed is:

1. A hydraulic system comprising:

an operation device that outputs an operation signal corresponding to an operating amount of an operating unit;

a pump that supplies hydraulic oil to a hydraulic actuator via a control valve;

a bleed valve that defines a bleed flow rate, at which the hydraulic oil discharged from the pump is released to a tank; and a controller that controls the bleed valve, such that an opening area of the bleed valve decreases in accordance with increase in the operation signal outputted from the operation device, wherein the controller determines whether or not a rapid acceleration operation is performed on the operation device, and the controller:

in a case where the rapid acceleration operation is not performed, changes the opening area of the bleed valve between a maximum value and zero along a normal opening line; and in a case where the rapid acceleration operation is performed, changes the opening area of the bleed valve between the maximum value and a minimum value greater than zero along a special opening line from when the rapid acceleration operation is started until when a predetermined time elapses.

2. The hydraulic system according to claim 1, wherein in the case where the rapid acceleration operation is performed, when the predetermined time has elapsed from the start of the rapid acceleration operation, the controller shifts the opening area of the bleed valve from a point on the special opening line to a point on the normal opening line.

3. The hydraulic system according to claim 1, wherein the pump is a variable displacement pump, the hydraulic system further comprises a regulator that adjusts a tilting angle of the pump, and the controller controls the regulator, such that a discharge flow rate of the pump increases in accordance with increase in the operation signal outputted from the operation device.

4. The hydraulic system according to claim 1, wherein the pump is a variable displacement pump, and the hydraulic system further comprises:

the control valve interposed between the pump and the hydraulic actuator, the control valve adjusting an amount of the hydraulic oil supplied to the hydraulic actuator; and a regulator that adjusts a tilting angle of the pump, such that a pressure difference between an upstream-side pressure and a downstream-side pressure of a meter-in restrictor of the control valve is constant, the regulator increasing a discharge flow rate of the pump in accordance with increase in the operation signal outputted from the operation device.

5. The hydraulic system according to claim 2, wherein the pump is a variable displacement pump, the hydraulic system further comprises a regulator that adjusts a tilting angle of the pump, and the controller controls the regulator, such that a discharge flow rate of the pump increases in accordance with increase in the operation signal outputted from the operation device.

6. The hydraulic system according to claim 2, wherein the pump is a variable displacement pump, and the hydraulic system further comprises:

the control valve interposed between the pump and the hydraulic actuator, the control valve adjusting an amount of the hydraulic oil supplied to the hydraulic actuator; and a regulator that adjusts a tilting angle of the pump, such that a pressure difference between an upstream-side pressure and a downstream-side pressure of a meter-in restrictor of the control valve is constant, the regulator increasing a discharge flow rate of the pump in accordance with increase in the operation signal outputted from the operation device.

* * * * *